United States Patent [19]

Troup et al.

[11] Patent Number: 4,486,229

[45] Date of Patent: Dec. 4, 1984

[54] CARBOTHERMIC REDUCTION WITH PARALLEL HEAT SOURCES

[75] Inventors: Robert L. Troup, Murrysville; David T. Stevenson, Washington Township, Washington County, both of Pa.

[73] Assignee: Aluminum Company of America, Pittsburgh, Pa.

[21] Appl. No.: 472,680

[22] Filed: Mar. 7, 1983

[51] Int. Cl.[3] ..... C22B 21/00

[52] U.S. Cl. ..... 75/68 R; 75/10 R

[58] Field of Search ..... 75/10 R, 68 R

[56] References Cited

U.S. PATENT DOCUMENTS

| | | | |
|---|---|---|---|
| 3,661,561 | 5/1972 | Frey et al. | 75/68 R |
| 3,758,289 | 9/1973 | Wood | 75/10 |
| 4,033,757 | 7/1977 | Kibby | 75/10 R |
| 4,053,303 | 10/1977 | Cochran et al. | 75/68 A |
| 4,162,167 | 7/1979 | Enomoto et al. | 106/44 |
| 4,216,010 | 8/1980 | Kibby | 75/68 A |
| 4,269,620 | 5/1981 | Johansson | 75/11 |
| 4,299,619 | 11/1981 | Cochran et al. | 75/10 R |
| 4,334,917 | 6/1982 | Kibby | 75/10 R |

FOREIGN PATENT DOCUMENTS 56-150141 11/1981 Japan .
56-150142 11/1981 Japan .
56-150143 11/1981 Japan .

OTHER PUBLICATIONS

"Carbothermic Smelting of Aluminum", P. T. Stroup, *Transactions of the Metallurgical Society of AIME*, Apr., 1964.

"Reaction of Clay and Carbon to Form and Separate $Al_2O_3$ and SiC", B. C. Bechtold and I. B. Cutler, *J. Am. Cer. Soc.*, May/Jun. 1980.

"Reductio ad Aluminium", *Far Eastern Economic Review*, Jun. 18, 1982.

*Primary Examiner*—Peter D. Rosenberg

*Attorney, Agent, or Firm*—Douglas G. Glantz

[57] ABSTRACT

Disclosed are apparatus and method of carbothermic direct reduction for producing an aluminum alloy from a raw material mix including aluminum oxide, silicon oxide, and carbon wherein parallel heat sources are provided by a combustion heat source and by an electrical heat source at essentially the same position in the reactor, e.g., such as at the same horizontal level in the path of a gravity-fed moving bed in a vertical reactor. The present invention includes providing at least 79% of the heat energy required in the process by the electrical heat source.

23 Claims, 2 Drawing Figures

CARBOTHERMIC REDUCTION WITH PARALLEL HEAT SOURCES

The Government of the United States of America has rights in this invention pursuant to Contract No. DEAC01-77CS40079 awarded by the Department of Energy.

BACKGROUND OF THE INVENTION

The present invention relates to a method for the carbothermic reduction of aluminum oxide and silicon oxide to form an aluminum alloy wherein at least a portion of the heat required by the process is provided by an in situ combustion with oxygen gas such as in a blast furnace.

The predominant commercial process today for producing aluminum metal is the Hall-Heroult process of electrolytically dissociating alumina dissolved in a fused cryolitic bath at a temperature less than about 1000° C. Many attempts have been made to displace this process and produce aluminum commercially by a direct thermal reduction process of aluminum oxide with carbon at sufficiently high temperatures according to a reaction written as:

$$Al_2O_3+3C \rightarrow 2Al+3CO. \quad (1)$$

However, such a process has presented a substantial technical challenge in that certain difficult processing obstacles must be overcome. For example, at the temperatures necessary for the direct thermal reduction of alumina to form aluminum, e.g., such as about 2050° C., the aluminum volatilizes to a gas of aluminum metal or aluminum suboxide rather than forming as aluminum metal liquid which may be tapped from the process. For this reason, most attempts have incorporated an electrical furnace for the purpose of reducing the amount of volatile gaseous constituents in the system.

Another problem found in attempts to reduce alumina thermally with carbon in the absence of other metals or their oxides shows up in substantial formations of aluminum carbide according to the reaction:

$$2Al_2O_3+9C \rightarrow Al_4C_3+6CO \uparrow \quad (2)$$

which proceeds favorably at or above 1800° C. Other intermediate compounds also are formed such as oxycarbides by the reactions:

$$4Al_2O_3+Al_4C_3 \rightarrow 3Al_4O_4C \text{ and} \quad (3)$$

$$Al_4O_4C+Al_4C_3 \rightarrow 4Al_2OC. \quad (4)$$

These carbides and oxycarbides of aluminum readily form at temperatures lower than the temperatures required for significant thermal reduction to aluminum metal and represent a substantial slag-forming problem in any process intended to produce aluminum. A comprehensive overview of technical attempts to overcome the problems in achieving a process for the thermal reduction of alumina with carbon to form aluminum metal is found in *Carbothermic Smelting of Aluminum*, by P. T. Stroup, Transactions of the Metallurgical Society of AIME, April, 1964.

An early attempt to produce aluminum alloy by carbothermic reduction and to avoid the volatilization problem is represented by the Cowles process, which probably is the first thermal process for the reduction of alumina with carbon that ever reached a commercial stage. The Cowles process used a collector metal of copper added to an alumina-carbon charge in an electric furnace to produce aluminum alloy. However, it was never found economically feasible to remove the copper collector metal from the aluminum alloy produced in the Cowles process.

Thermodynamic calculations and experience have shown that all the major oxides in bauxite except zirconia are reduced by carbothermic smelting before alumina is reduced. In practice, however, the oxides do not behave as simply as predicted. Instead, intermediate compounds are formed such as carbides, oxycarbides, and volatile subcompounds. Nevertheless, it has been recognized that it would be propitious to use a collector metal for promoting the absorption of aluminum vapor set free at the high temperatures required for the reduction reaction, thus preventing loss of aluminum by volatilization and carbide formation, which collector metal could form a commercially desirable alloy with aluminum. Silicon would be one such desirable collector metal since silicon has a higher boiling point, i.e., 3280° C., than copper (2560° C.) as used previously in the Cowles process, and further since silicon oxide, combined with aluminum oxide, occurs in nature in almost unlimited quantities. It has been reported that aluminum-silicon alloys were produced commercially by carbothermic smelting in Germany during World War II at a power consumption of 14 to 16 kw hour per kilogram alloy. The German process used a molten salt bath containing cryolite to refine the furnace alloy and remove carbides, nitrides, oxides, calcium, and magnesium.

The discussion to this point has referred to prior attempts at the direct thermal reduction of alumina with carbon and other compounds incorporating electrical furnace heating as the sole energy source for the purpose of reducing volatilized components including those of aluminum or aluminum suboxide. These processes nevertheless have not overcome problems attributable to the formation of carbides and oxycarbides. Such problems include the formation of reactor-fouling agglomerations and degradation of any metal produced. Kibby, U.S. Pat. No. 4,033,757, U.S. Pat. No. 4,216,010, and U.S. Pat. No. 4,334,917 illustrate the nature of such carbide formation problems and represent various attempts to minimize or cure the effect on aluminum formation.

It has been recognized that a method of making aluminum-silicon alloy in a blast furnace would be commercially desirable by substituting a less expensive combustion heating for the electrical furnace. Frey et al, U.S. Pat. No. 3,661,561, disclose a process for producing aluminum-silicon alloy in a blast furnace using carbon, an alumina-silicon ore, and pure oxygen. According to the patent, oxygen reacts with carbon to form carbon monoxide gas to maintain temperatures in excess of 2050° C. in the reaction zone of the furnace. Silicon carbide lumps are placed in the furnace bed to prevent aluminum carbide or silicon carbide forming with the carbon from the coke in sufficient quantity to be a processing problem. Assuming that the Frey et al process is operative to avoid the formation of carbide and oxycarbide slag in reactor-fouling amounts, Frey et al do not overcome the substantial problem of the formation of volatile components such as aluminum gas and aluminum suboxide gas which will form in the blast furnace disclosed to operate at temperatures in excess of 2050° C. Moreover, Frey et al do not disclose the method for forming silicon carbide.

The Atcheson process represents the principal commercial method for manufacturing silicon carbide from a mixture of sand and coke in an electrically resistance-heated batch-type operation. The Atcheson process is highly intensive in both labor and electrical energy.

Enomoto, U.S. Pat. No. 4,162,167, discloses a continuous process for producing silicon carbide from silica and carbon by heating to a temperature of 1600°-2100° C. in an electrical furnace.

Johansson, U.S. Pat. No. 4,269,620, discloses a process for producing silicon by reducing silicon oxide through an intermediate silicon carbide. Electrical energy is used to generate silicon suboxide gas which in a preheat zone reacts with carbon to form the silicon carbide.

Bechtold and Cutler, "Reaction of Clay and Carbon to Form and Separate $Al_2O_3$ and SiC, " *J. Am. Cer. Soc.*, May-June 1980, disclose producing alumina and silicon carbide from clay by carbon reduction proceeding through intermediates of CO and SiO. Bechtold et al employ temperatures up to 1505° C. by an electrically heated furnace.

Others have recognized the desirability of substituting a blast furnace energy source for electrical heat in the formation of the silicon carbide. Attempts also have been made to combine a staged silicon carbide formation with and as part of an attempt at carbothermically reducing alumina and silica with carbon. For example, Wood, U.S. Pat. No. 3,758,289,discloses the prereduction of an alumina-silica ore which is then thermally smelted in an electric arc furnace. No attempt is made in Wood to separate alumina from the alumina-silica ore prior to prereduction, and alumina thereby is present in the process disclosed to reduce the silica in the ore to silicon carbide. Prereduction is carried out at approximately 1500°-1800° C., and preferably at a temperature in the range of 1600°-1700° C.

Cochran, U.S. Pat. No. 4,053,303, discloses a process where the prereduction step of forming silicon carbide from alumina, silica, and carbon is carried out as a first stage in a multistage reactor. Prereduction to form silicon carbide is disclosed at a temperature in the range of 1500°-1600° C. The ore is processed through subsequent continuous stages, either in a blast furnace or electric furnace with the blast furnace technique being preferred because of economics, to form an aluminum-silicon alloy.

Any attempt to substitute a blast furnace for an electrical furnace in an attempt to reduce an aluminum-silicon ore by carbothermic techniques must first overcome problems associated with the volatilization of the desired products, which volatilization is detrimentally encouraged by the gases formed in the blast furnace.

One direction taken to reduce the volatility problem is found in Cochran et al, U.S. Pat. No. 4,299,619. Cochran et al disclose a process utilizing a two-zone reactor, wherein the first zone is heated to a reaction temperature of about 2050° C. by the internal combustion of carbon and the second or lower zone is heated electrically to a temperature of about 2100° C. Alumina and carbon are inserted to the upper zone and reacted at an elevated temperature to form CO and a first liquid of alumina and aluminum carbide. The first liquid is then transferred to a lower reaction zone beneath the upper reaction zone and heated to form CO and a second liquid of aluminum and carbon. Oxygen is added to preheat reactants in the upper zone and to maintain a desired reaction temperature. The lower zone is electrically heated by an electric resistance heater or alternative heat sources such as an electric arc or other heat sources not producing large volumes of gas.

Kuwahara has filed disclosure Nos. 56-150141, 56-150142, and 56-150143 with the Japanese Patent Agency disclosing a smelting method of aluminum by reduction in a blast furnace using oxygen injecting tuyeres to achieve temperatures in the range of 2000°-2100° C. at the tuyere level of the blast furnace. An article entitled "Reductio ad aluminium, " *Far Eastern Economic Review*, June 16, 1982, at page 63, inexplicably refers to the Kuwahara process as charging aluminous ore briquettes into a blast furnace heated by an electric arc and the combustion of coke in the presence of oxygen in air to sustain temperatures of 2000° C. Notwithstanding this inexplicable mention of the use of electric arc and the combustion of coke, the Kuwahara patent application disclosures nowhere suggest the use of a blast furnace heated by an electric arc. The *Far Eastern Economic Review* article must be characterized as far from an enabling disclosure. The Kuwahara process employs a molten lead spray splashed into the furnace at 1200° C. to scrub and absorb molten metal product at the bottom of the furnace.

Despite a considerable technical effort expended in the attempt to achieve a process for the production of aluminum and silicon alloy by the direct reduction of aluminum oxide and silicon oxide raw materials, processes disclosed to date have been unsuccessful in substituting combustion heating for the electrical furnace. Such a process for employing less expensive and more efficient combustion heating while overcoming the significant problems of product volatilization and reactor-fouling slag formation has been unavailable until now.

SUMMARY OF THE INVENTION

In accordance with the present invention, apparatus and process are provided for the carbothermic direct reduction of an aluminum oxide and a silicon oxide to produce an aluminum-silicon alloy.

The process of the present invention includes feeding a raw material mix including aluminum oxide, silicon oxide, and carbon to a reactor; heating the mix in the reactor to an elevated temperature by parallel heat sources provided by a combustion heat source and by an electrical heat source located at essentially the same position in the reactor; and withdrawing aluminum-silicon alloy from the reactor. The process for producing an aluminum-silicon alloy includes providing at least 79% of the heat energy required in the process by the electrical heat source. The combustion heat source is employed to provide at least 8% of the required heat energy.

The present invention further includes a method of carbothermic direct reduction for producing an aluminum alloy including feeding to a reactor a raw material mix of aluminum oxide, silicon oxide, carbon, and a noncarbide-forming raw material of iron, tin, copper, iron oxide, tin oxide, or copper oxide; heating the mix to an elevated temperature by parallel heat sources provided by a combustion heat source and by an electrical heat source; and withdrawing aluminum alloy from the reactor.

The present invention includes apparatus for carrying out a method of the invention and further includes a reactor useful for producing aluminum-silicon alloy by the carbothermic direct reduction of an ore containing aluminum oxide and silicon oxide reaction materials. The reactor provides means for containing the reaction materials at an elevated temperature; means for feeding raw material ore in the form of agglomerate or pellet into the containing means; parallel heat sources in the containing means consisting of a combustion heat source and an electrical heat source at essentially the same level in the containing means, wherein the electrical heat source is capable of providing at least 79% of the heat energy required for the direct reduction of the feed and the combustion source is capable of providing at least 8% of the heat energy; and means for withdrawing metal alloy from the containing means.

DETAILED DESCRIPTION

Figure 1:
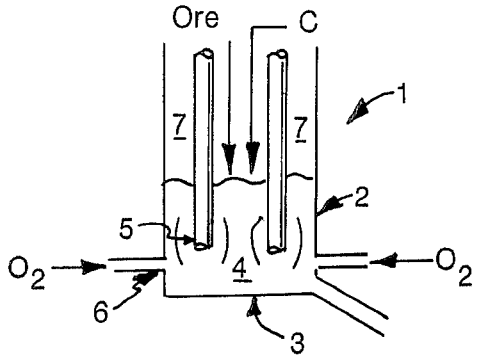
FIG. 1 is a schematic elevation illustrating the apparatus and the process of the present invention for carbothermic reduction of alumina to form an aluminum alloy using one reactor and parallel heat sources.

A combustion heated process for carbothermically smelting an aluminum oxide and silicon oxide to form an aluminum-silicon alloy cannot be visualized merely as an iron blast furnace-type reactor modified for higher temperature operation and injection of $O_2$ instead of air. For reactions occurring in a packed bed of ore and coke with countercurrent flow of carbon monoxide gas generated by burning coke in the combustion zones located in front of oxygen injecting tuyeres, and generated as a product of reduction reactions, a number of significant differences exist between iron and aluminum-silicon production processes.

Temperatures for aluminum-silicon alloy formation by the direct thermal reduction of alumina and silica are much higher than those in an iron smelting process, e.g., minimum temperatures of about 2000° C. for aluminum-silicon alloy compared to about 1500° C. for iron. Since less heat is available from combustion when the heat must be supplied at a higher temperature and since aluminum-silicon smelting is much more endothermic than that for iron, the fuel rate for aluminum-silicon smelting is expected to be much higher than for iron smelting.

Thermodynamics show that carbon monoxide can reduce $Fe_2O_3$, but CO cannot reduce $SiO_2$ or $Al_2O_3$. Direct reduction by carbon is required. For aluminum-silicon smelting, a ratio of $CO_2/CO$ is about zero assuming negligible Boudouard reaction, while for iron smelting the $CO_2/CO$ approximates one. Therefore, reduction reactions in the carbothermic reduction of aluminum oxide and silicon oxide alone result in greater gas volumes consisting of primarily CO.

The reduction reactions to form aluminum and silicon from aluminum oxide and silicon oxide proceed by gaseous intermediates as opposed to a simple gas-solid reaction between CO or $H_2$ and $Fe_2O_3$ to produce Fe and $CO_2$ or $H_2O$. The refluxing species Al, $Al_2O$, and SiO back react with CO at lower temperatures, forming deposits which cause reactor-fouling agglomerations resulting in bridging. The charge tends to become cemented together and solids flow is held up. Although SiO may cause problems in a ferrosilicon or ferromanganese blast furnace, reflux of alkalis rather than suboxides can cause similar problems in a normal iron blast furnace. As reflux increases, the shaft behaves as a heat pipe which absorbs heat at high temperatures and liberates heat at low temperatures, resulting in increases in fuel rate and high off-gas temperatures.

Excess carbon in contact with aluminum-silicon alloys at alloy-formation temperatures can cause rapid carbide formation which prevents recovery of the alloy. As to the iron blast furnace, however, liquid iron containing about 4.5% C. is in equilibrium with carbon at normal blast furnace temperatures. The carbon content of aluminum-silicon alloys, on the other hand, is an anomalous function of composition and temperature.

Thermodynamically, the standard free energy of oxide formation with respect to temperature indicates that carbon reduces alumina and silica at about 2000° C. and about 1540° C., respectively. However, the presence of stable suboxides, oxycarbides, carbides, and vapors in a system of Al—Si—O—C at high temperatures must be recognized, and many species must be considered in a calculation of equilibrium products . Using recent $Al_2O$ data and assuming an ideal solution behavior of any aluminum-silicon alloy produced, thermodynamic calculations indicate that the production of aluminum-silicon alloy from a raw material charge of alumina, silica, and carbon in a process heated exclusively by combustion heating in situ, i.e., such as in the form of a blast furnace, probably is not feasible. However, such a conclusion is based on assumptions and data having an uncertainty sufficiently large that technical feasibility cannot be ruled out on the basis of thermodynamic calculations alone.

Nevertheless, it has been found from actual observation that severe reactor-fouling agglomerations and bridging problems occur when smelting aluminum oxide and silicon oxide ores together in one reactor. The problems are directly attributable to refluxing of the vapor as metal and suboxide species.

It has been found that the substitution of in situ combustin heat for a portion of electrical heat at different levels in one reactor causes virtually insurmountable problems of reactor-fouling attributable to bridging and slag formation around the combustion heat zone. One reason this occurs is the fact that in situ combustion heat produces a very high temperature in the zone of combustion, especially with combustion in an atmosphere rich in oxygen. By in situ combustion heat is meant direct heating by hot combustion gases which usually are produced in the reaction zone itself by a combustion of oxygen with carbon. These temperatures in the case of in situ combustion heat by combustion of carbon with essentially pure oxygen typically are in the range of 3500°-4000° C. Such high temperatures in a reactor combustion zone located to provide unilateral combustion heating and containing alumina, silica, and carbon have been found to cause considerable bridging and slagging problems which usually are substantial enough to shut down the reactor.

However, in accordance with the present invention, a process and apparatus have been discovered and are herein disclosed for providing in situ combustion heat utilized in one reactor for only a portion of the high temperature heat required in the formation of an aluminum alloy from aluminum oxide by carbothermic direct reduction. Not only has it been found that the location or position in the reactor at which the combustion heat source is placed relative to the electrical heat source is critical, but also it has been found that critical limitations on the amount of combustion heat provided to the one reactor process must be observed. In this way, gaseous sweep rate, including CO sweep rate from the combustion heat source, through the alloy-producing reactor is held sufficiently low in amount and temperature to avoid losses of aluminum to volatilization and to carbide-forming slag.

Accordingly, it is an object of the present invention to substitute combustion heating for electrical heating while minimizing detrimental volatilization of metal and metal suboxide in a process for producing an aluminum alloy by the carbothermic reduction of aluminum oxide.

It is a further object of the present invention to substitute combustion heating for electrical heating in a process for the carbothermic reduction of aluminum oxide while minimizing the formation of reactor-fouling bridging.

It is an object of the present invention to provide a method and apparatus for the carbothermic reduction of aluminum oxide and silicon oxide to form an aluminum-silicon alloy including heating a mix of aluminum oxide, silicon oxide, and carbon in a reactor by parallel heat sources provided by a combustion heat source and by an electrical heat source.

These and other objects will become apparent from the drawings and from the detailed description which follows.

Referring now to FIG. 1, reactor 1 having side wall 2 and base 3 suitable for containing a reaction at elevated temperature, and having feeding means (not shown) as conventionally known for feeding raw material, e.g., from the top, to the internal reaction zone 4 of reactor 1, is provided with parallel heating sources 5 and 6. By parallel heating sources is meant heating sources located substantially at the same position in reactor 1. For example, parallel would mean at the same horizontal level in the case of a vertical shaft reactor, such as which may be used with a gravity-fed, moving bed process. Parallel heat sources comprise heat sources placed sufficiently contiguous to each other in the reactor such that their heat inputs would provide a superimposed thermal influence to the same zone of the reacting bed while not passing all of the combustion CO through the entire metal-producing zone. For example, the combustion input could be located at the top of the metal-producing zone so as to supply heat to the balance of this zone primarily by radiation heat transfer or the radiation of convectively heated intermediaries in front of the combustion input. In this way rising combustion CO sweep gases would increase volatiles formation only in the top part of the metal-producing zone and allow higher amounts of combustion heat.

Heat source 5 is illustrated as electrodes for providing a submerged arc. Other suitable electrical means for heat source 5 include a plasma torch using carbon oxide gas. Alternative electrical means can include resistance heating through plasma gases in the reactor. Heat source 6 forming the other component parallel heat source includes a combustion-type heat source, such as an oxygen-injecting tuyere for producing combustion with carbon in reaction zone 4. An alternative combustion heat source includes a burner through which carbon such as char can be injected along with oxygen gas.

An atmosphere rich in oxygen is preferred, e.g., over air, to achieve the high temperatures required for aluminum production. The use of air also produces undesirable formation of nitrides. It is preferred to use an atmosphere rich in oxygen gas containing at least 90% by volume oxygen gas, and more preferably essentially pure oxygen gas, i.e., at least about 98% by volume oxygen gas.

Raw material ores to be smelted are fed to reactor 1, e.g., to the top of reactor 1 as illustrated here in one embodiment. Alumina with silica and optionally with a noncarbide-forming material such as iron, tin, or copper or an oxide thereof, i.e., iron oxide, tin oxide, or copper oxide, are fed to the top of reactor 1 and can be transported as a gravity-fed moving bed through reactor 1 to reaction zone 4. The moving bed is preheated in the top zone 7 of reactor 1. Silica will be reduced in top zone 7 to silicon carbide by hot gases rising in the reactor. By the time the moving bed reaches the parallel heat zone, much if not all of the silica is converted to silicon carbide. Coke and some silicon carbide combust with oxygen injected through tuyere 6 to form SiO gas and CO gas. These hot gases then rise through the moving bed to preheat and react the moving bed at temperatures less than metal-forming temperatures. All the silicon carbide in the moving bed does not combust with oxygen, but rather a portion passes to reaction zone 4 with alumina, aluminum carbide, and aluminum oxycarbide which react in the metal-forming temperatures of the reaction zone 4 supplied by the parallel heat sources, e.g., at temperatures between about 2000°–2400° C. to form an aluminum alloy. Temperatures in the range of from about 2000° C. to about 2100° C. are preferred. Temperatures above about 2100° C. result in undesirably higher volatilization of aluminum metal and aluminum suboxide.

It has been found that the electric heat source of the parallel heat sources must provide at least 79% of the heat energy required in the process. If less energy is provided by the electric heat source, i.e., if more than 21% of the heat energy required in the process is provided by the combustion heat source, the process will substantially fail to produce metal, and rather volatilization will cause product losses to vapor or slag formation. In this way, the present invention provides about 21% of the heat energy in the form of in situ combustion heat. However, the method of the present invention provides at least 8% of the heat energy required in the process by the combustion heat source. Combustion heat thereby can provide from about 8 to about 21% of the heat energy required in the process and provided by the parallel heat sources. Preferably, combustion heat provides at least about 10% and up to about 21% of the heat energy required in the process. More combustion heat is preferred since electrical heat will be displaced, resulting in a desirable substitution of less expensive and more efficient combustion heat for the electrical heat source.

The raw material mix fed to the top of reactor 1 should be finely divided and mixed in the form of agglomerate or pellet. Such a preparation will permit an enhanced structure for operation of the gravity-fed moving bed. The agglomerate or pellet should have a particle size in the range of about $\frac{1}{4}$ inch to $\frac{5}{8}$ inch.

Figure 2:
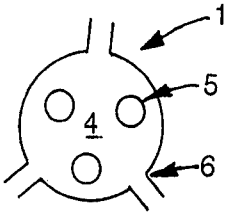
FIG. 2 illustrates a schematic plan view of the reactor shown in FIG. 1.

Referring now to FIG. 2, a top view of reactor 1 is shown, having electrical heat source 5 and combustion heat source 6. A heat source configuration is illustrated wherein the electrical heat source 5 and the combustion heat source 6 are positioned to provide the greatest uniformity of heating reaction zone 4 over a cross section of reactor 1.

The method of the present invention for carbothermic direct reduction includes the production of an aluminum alloy from a raw material mix of alumina, silica, carbon, and a noncarbide-forming raw material of iron, tin, copper, or iron oxide, tin oxide, or copper oxide. These noncarbide-forming elements may also be fed in their metallic form as recycle material either as liquids or solids from purification of the alloy tapped from this process. These noncarbide-forming elements provide a diluent in the alloy to reduce aluminum and silicon activities and volatility in elemental or suboxide form. Accordingly use of such diluents enhances the use of higher levels of combustion heat within the preferred range of 10–21% without excessive reactor-fouling volatile formation. Levels of combustion heat beyond 21% are then possible. The amount of diluents fed to the process to increase the amount of combustion heat has no theoretical upper limits. However, excessive use of diluent becomes impractical with respect to energy requirements to heat the diluent and problems of handling large amounts of diluent for small amounts of useful alloy recovery during purification steps.

ILLUSTRATIVE EMBODIMENT 41 parts alumina, 32 parts silica, and 27 parts reduction carbon are fed to the top of a vertical shaft reactor which is heated by a parallel heat source, i.e., by an electric heat source and by a combustion heat source located on essentially the same horizontal level of the vertical shaft reactor. In situ combustion heat is supplied at varying quantities of the heat required to perform a metal-forming operation at a temperature of about 2080° C. The remainder of the required heat is supplied by the electrical heat source, in this case, by submerged arc. At the varying quantities of combustion heat, aluminum is vaporized as aluminum vapor and aluminum suboxide gas, i.e, $Al_2O$, and a recycle ratio is determined representing total mols Al vaporized/mol aluminum in the alloy. The aluminum recycle ratio is shown in Table I at various fuel rates in mols carbon/mol aluminum produced and the corresponding amount of heat supplied by the combustion heat source to the process.

The data in Table I show that in the case where $Al_4O_4C$ and SiC react to produce alloy an unacceptably high recycle rate appears at or about 21% combustion heat supplied to the process for producing aluminum-silicon alloy. At this level of combustion heat, the aluminum recycle rate is at least about 3.4. In such case, 3.4 mols aluminum are vaporized for each mol produced in the alloy. At such a rate, most aluminum will be vaporized as metal vapor or aluminum oxide and suboxide gas.

TABLE I

Effect of In-Situ Combustion Heat on Aluminum Volatiles

| Fuel Rate (mols C/mol Al produced) | Combustion Heat % of Total | Recycle Ratio of Aluminum |
|---|---|---|
| 1 | 8.4 | 1.1 |
| 5 | 20.4 | 3.4 |
| 10 | 24.8 | 6.3 |
| 20 | 27.8 | 12.1 |
| 100 | 30.8 | 58.5 |

EXAMPLE 1

Silica, alumina, and carbon were fed as a raw material mix in varying compositions to the top of a vertical shaft reactor. The feed mix also included minor amounts of iron oxide. The reactor was heated to various temperatures above 2100° C. by a parallel heat source, including a CO-producing, in situ combustion heat source and an electrical resistance heat source. Various fuel rates were calculated and are shown in Table II.

Metal was successfully produced as shown in Table II.

Runs 2 and 6 have $SiO_2/Al_2O_3$ feed ratios which permit a comparison of the fuel rates as shown in Table II for a certain $SiO_2/Al_2O_3$ ratio, viz. about 0.78. These metal-forming runs correlate well with the Fuel Rate and corresponding Recycle Ratio at the various combustion heat levels shown in Table I. In the Table I data, the reaction of $Al_4O_4C$ with SiC is assumed since this reaction produces alloy at a well defined temperature by a single reaction. At lower $SiO_2/Al_2O_3$ ratios, i.e., below about 0.78, another reaction between $Al_4O_4C$ and $Al_4C_3$ or $Al_4SiC_4$ also occurs, while at higher $SiO_2/Al_2O_3$ ratios, i.e., above about 0.78, still another reaction between $Al_2O_3$ and SiC occurs. Thus, Table I was found accurate at the selected $SiO_2/Al_2O_3$ ratio.

TABLE II

Effect of In Situ Combustion Heat on Aluminum Alloy Formation

| Run No. | 1 | 2 | 3 | 4 | 5 | 6 |
|---|---|---|---|---|---|---|
| $SiO_2/Al_2O_3$ Feed, wt. ratio | .50 | .79 | .99 | 1.22 | .99 | .78 |
| Wt. % Stoichiometric C in Ore | 64.2 | 56.7 | 63.7 | 72.6 | 63.7 | 80.5 |
| Total Wt. % Stoichiometric C in Ore | 80.1 | 80.0 | 80.0 | 78.5 | 80.0 | 80.5 |
| Wt. % $Fe_2O_3$ impurities | 3.0 | 2.9 | 2.7 | 1.9 | 2.7 | 2.1 |
| CO flow (1pm) | 15 | 15 | 15 | 15 | 15 | 15 |
| Time >2000° C. (min.) | 215 | 245 | 280 | 130 | 155 | 291 |
| Time CO on (min.) | 299 | 305 | 385 | 290 | 265 | 365 |
| $T_{max}$ (°C.) | 2110 | 2120 | 2115 | 2155 | 2115 | 2105 |
| Average Metal Analysis wt. basis | | | | | | |
| % Al | 56.0 | 52.4 | 45.8 | 42.5 | 41.1 | 45.9 |
| % Si | 23.7 | 26.5 | 29.5 | 34.0 | 31.9 | 30.8 |
| % Fe | 5.5 | 5.8 | 5.5 | 5.0 | 5.1 | 3.7 |
| % Ti | 3.4 | 2.9 | 2.7 | 2.2 | 5.9 | 3.0 |
| % O | 3.1 | 2.9 | 7.3 | 4.8 | 2.9 | 3.9 |
| % C | 7.6 | 4.7 | 6.1 | 6.7 | 7.5 | 8.6 |
| Total % | 99.3 | 95.2 | 96.9 | 95.2 | 93.9 | 95.9 |
| Al Metal Yield (gm) | 915 | 935 | 676 | 287 | 613 | 773 |
| Si Yield (gm) | 413 | 504 | 530 | 263 | 508 | 572 |
| Actual Wt. Metal / Max. Wt. Metal | .34 | .45 | .40 | .46 | .40 | .35 |
| Fuel Rate (mols CO/mols Al produced) | 4.2 | 4.7 | 7.5 | 8.2 | 4.6 | 6.8 |

EXAMPLE 2

A procedure similar to that of Example 1 was followed with the exception that the CO flow rate was increased from 15 to 22.5 liters per mirute, representing an increase of about 50% of the in situ conbustion heat in the reactor. The results are shown in Table III.

No metal was formed at this higher combustion heat level, which corresponds to Table I in the high range of Recycle Ratio, i.e., in the range of above about 30.8% combustion heat supplied to the process.

TABLE III

Effect of In Situ Combustion Heat on Aluminum Alloy Formation

| Run No. | 1 | 2 |
|---|---|---|
| $SiO_2/Al_2O_3$ wt. ratio | .78 | .78 |
| Wt. % Stoichiometric C | 80.5 | 80.5 |

TABLE III-continued

| Effect of In Situ Combustion Heat on Aluminum Alloy Formation | | |
|---|---|---|
| Run No. | 1 | 2 |
| in Ore | | |
| Total Wt. % | 80.5 | 80.5 |
| Stoichiometric C | | |
| in Ore | | |
| Wt. % $Fe_2O_3$ impurities | 2.1 | 2.1 |
| CO flow (1 pm) | 22.5 | 22.5 |
| Time >2000° C. (min.) | 10 | 107 |
| Time CO on (min.) | 110 | 197 |
| $T_{max}$ (°C.) | 2085 | 2195 |
| Average Product Analysis | | |
| wt. basis | | |
| Al Metal Yield (gm) | None | None |
| Si Yield (gm) | None | None |
| Actual Wt. Metal | None | None |
| Max. Wt. Metal | | |

The examples and the illustrative embodiment taken together show that in the case of carbothermic reduction of alumina to produce an aluminum alloy, combustion heat produces the formation of volatile by-products which consume heat at a rate higher than that of aluminum metal formation. In this way, combustion heat works against itself above a certain level of contribution to a parallel heat source reactor. It has been found that the upper limit for the portion of combustion heat in the parallel heat source is about 31% combustion heat, which will provide a process to produce minute amounts of aluminum-silicon metal. In the practical sense, however, the upper limit is at or about 21% combustion heat which provides a recycle ratio of about slightly higher than 3.4. As the amount of combustion heat progressively is decreased, the recycle ratio improves in terms of metal formation. For example, at or about 8% combustion heat supplied to the parallel heat system, the recycle ratio can be seen to have been reduced to about 1.1.

What is claimed is:

1. A method of carbothermic direct reduction for producing an aluminum-silicon alloy comprising:
   feeding a raw material mix comprising alumina, silica, and carbon to a reactor;
   heating said mix in said reactor to an elevated temperature by an in situ combustion heat source located sufficiently contiguous to an electrical heat source to provide superimposed heating; and
   withdrawing said aluminum-silicon alloy from said reactor.

2. A method according to claim 1 wherein said electric heat source provides at least 79% of the heat energy required in said heating.

3. A method according to claim 2 wherein said combustion source provides at least 8% of said heat energy required in said heating.

4. A method according to claim 3 wherein elevated temperature comprises a temperature above 2050° C. and said combustion source provides heat in the range of about 10–21% of said heat energy.

5. A method according to claim 4 comprising providing said combustion source in the form of an oxygen-injecting tuyere.

6. A method according to claim 4 comprising said burner with a combustion mix comprising oxygen and combustion carbon.

7. A method according to claim 4 comprising providing said electrical heat by submerged arc.

8. A method according to claim 4 comprising providing said electrical heat by plasma torch using carbon oxide gas.

9. A method according to claim 8 further comprising electrical resistance heating through plasma gases in the reactor.

10. A method according to claim 4 wherein said mix comprises finely divided materials in the form of agglomerate or pellet.

11. A method according to claim 10 wherein said agglomerate or pellet has a particle size in the range of about $\frac{1}{4}$ to $\frac{5}{8}$ inch.

12. A method of direct reduction for producing an aluminum alloy comprising:
   feeding to a reactor a raw material mix comprising alumina, silica, carbon, and a noncarbide-forming raw material selected from the group consisting of iron, tin, copper, iron oxide, tin oxide, and copper, oxide;
   heating said mix in said reactor to an elevated temperature by parallel heat sources provided by a combustion heat source and by an electrical heat source to form an aluminum alloy;
   said parallel heat sources comprising heat sources sufficiently contiguous to provide a superimposed thermal influence; and
   withdrawing said aluminum alloy from said reactor.

13. A method according to claim 12 wherein said noncarbide-forming raw material is iron oxide.

14. A method according to claim 12 wherein said noncarbide-forming raw material is tin oxide.

15. A method of carbothermic reduction useful for producing aluminum-silicon alloy from alumina and silica-bearing materials comprising:
   feeding a material mix containing alumina, silica, and carbon into the top of a vertical shaft continuous reactor;
   passing said mix as a gravity-fed moving bed through a preheat zone in countercurrent flow against rising hot gases to form a preheated mix;
   heat the preheated mix to a temperature sufficient to form aluminum-silicon alloy and said hot gases in a reaction zone by parallel heat sources provided by an in situ combustion heat source and an electrical heat source, said parallel heat sources being positioned at essentially the same horizontal level in the path of the gravity-fed moving bed in said vertical reactor; and
   withdrawing aluminum-silicon alloy from the bottom of said vertical reactor.

16. A method according to claim 15 wherein said electrical heat source provides at least 79% of the heat energy required in said heating to form aluminum metal.

17. A method according to claim 16 wherein said combustion heat source provides at least 8% of the heat energy required in said heating to form aluminum metal.

18. A method according to claim 17 wherein said burner provides heat energy in the range of about 10–21% of the heat energy required in said heating to form aluminum metal.

19. A method according to claim 18 wherein said mix is fed to the top of said reactor in the form of agglomerate of finely divided raw material.

20. A method according to claim 19 wherein said agglomerate has a particle size in the range of about $\frac{1}{4}$ to $\frac{5}{8}$ inch.

21. A reactor useful for producing aluminum-silicon alloy by the carbothermic direct reduction of alumina and silica-bearing materials comprising:

means for containing reaction materials at an elevated temperature;

means for feeding raw material ore in the form of agglomerate or pellet into said containing means;

parallel heat sources in said containing means consisting of a combustion heat source and an electrical heat source at essentially the same level in said containing means, wherein said electrical heat source is capable of providing at least 79% of the heat energy required for the direct reduction of said feed to form aluminum-silicon alloy and said combustion source is capable of providing at least 8% of said heat energy; and means for withdrawing metal alloy from said containing means.

22. A reactor according to claim 21 wherein said combustion source comprises a burner or an oxygen-injecting tuyere.

23. A reactor according to claim 22 wherein said electrical heat source comprises a submerged arc or a plasma torch using carbon oxide gas.

* * * * *